United States Patent [19]

DeGregorio

[11] Patent Number: 4,590,628

[45] Date of Patent: May 27, 1986

[54] FOUNTAIN DEVICE

[75] Inventor: Anthony DeGregorio, Brooklyn, N.Y.

[73] Assignee: Preferred Services, Ltd., New York, N.Y.

[21] Appl. No.: 639,348

[22] Filed: Aug. 9, 1984

[51] Int. Cl.[4] ..... E03C 1/00

[52] U.S. Cl. ..... 4/191; 4/596; 4/597; 4/605; 239/444; 239/562; 251/315

[58] Field of Search ..... 4/290, 292, 191, 596, 4/597, 601, 605, 620, 624; 137/862, 864, 614.11; 251/315, 310; 239/562, 551, 571, 574, 444

[56] References Cited

U.S. PATENT DOCUMENTS

| | | | |
|---|---|---|---|
| 1,208,243 | 12/1916 | Vondenbosch | 239/444 |
| 2,588,255 | 3/1952 | Larsh | 239/444 X |
| 2,675,270 | 4/1954 | Clougherity et al. | 239/444 |
| 2,735,447 | 2/1956 | Ray | 239/864 X |
| 3,108,748 | 10/1963 | Fiore | 251/310 X |
| 3,214,133 | 10/1965 | Rodger et al. | 239/562 |

*Primary Examiner*—Henry K. Artis

*Attorney, Agent, or Firm*—McAulay, Fields, Fisher, Goldstein & Nissen

[57] ABSTRACT

A fountain device selectively produces either a spray or a stream of water when used with a hose. The device includes a hollow body portion which has a water inlet formed at one end thereof. The body portion includes a water exit surface formed with both a plurality of small water exit ports and a large water exit port therein. A flow selecting valve is provided which has three states: an off state in which no water flows through the body portion, a spray producing state in which water flows through the body portion and exits therefrom through the plurality of small water exit ports, and a stream producing state in which water flows through the body portion and exits therefrom through the large water exit port. The flow selecting valve is positioned downstream of said water inlet and upstream of said water exit ports.

8 Claims, 7 Drawing Figures

FOUNTAIN DEVICE

BACKGROUND OF THE INVENTION

The present invention relates to a water dispensing device which can selectively deliver either a spray or a stream of water, and more particularly to such a device which is controllable by a single control mechanism.

When sun-bathing or otherwise relaxing out of doors, it is desirable to have an easily accessible source of either a mist-like spray of water to cool one's self or a single stream of water to drink from. It is further desirable to have this water source at a location as close as possible to the user.

Accordingly, it is an object of this invention to provide a fountain device which can selectively deliver either a stream or a spray of water.

It is a further object of the invention to provide such a device which can be easily attached to a chair or chaise.

An additional object of this invention is to provide such a device which is both inexpensive and easy to manufacture.

BRIEF DESCRIPTION

In one embodiment of the invention, a fountain device is provided which is usable with a garden hose. The device can selectively deliver either a spray or a stream of water. The fountain device includes an elongated hollow body portion having a water inlet at one end thereof. A water exit surface is provided on the hollow body portion. The water exit surface is formed with both a plurality of small water exit ports and a large water exit port therein.

The flow of water from the device is controlled by a flow selecting valve which has three states: an off state in which no water flows through the hollow body portion; a spray producing state in which water flows through the hollow body portion and exits therefrom through the plurality of small water exit ports; and a stream producing state in which the water flows through the body portion and exits therefrom through the large water exit port. The flow selecting valve is positioned downstream of the water inlet and upstream of the water exit ports.

DESCRIPTION OF THE PREFERRED EMBODIMENT

Figure 1:
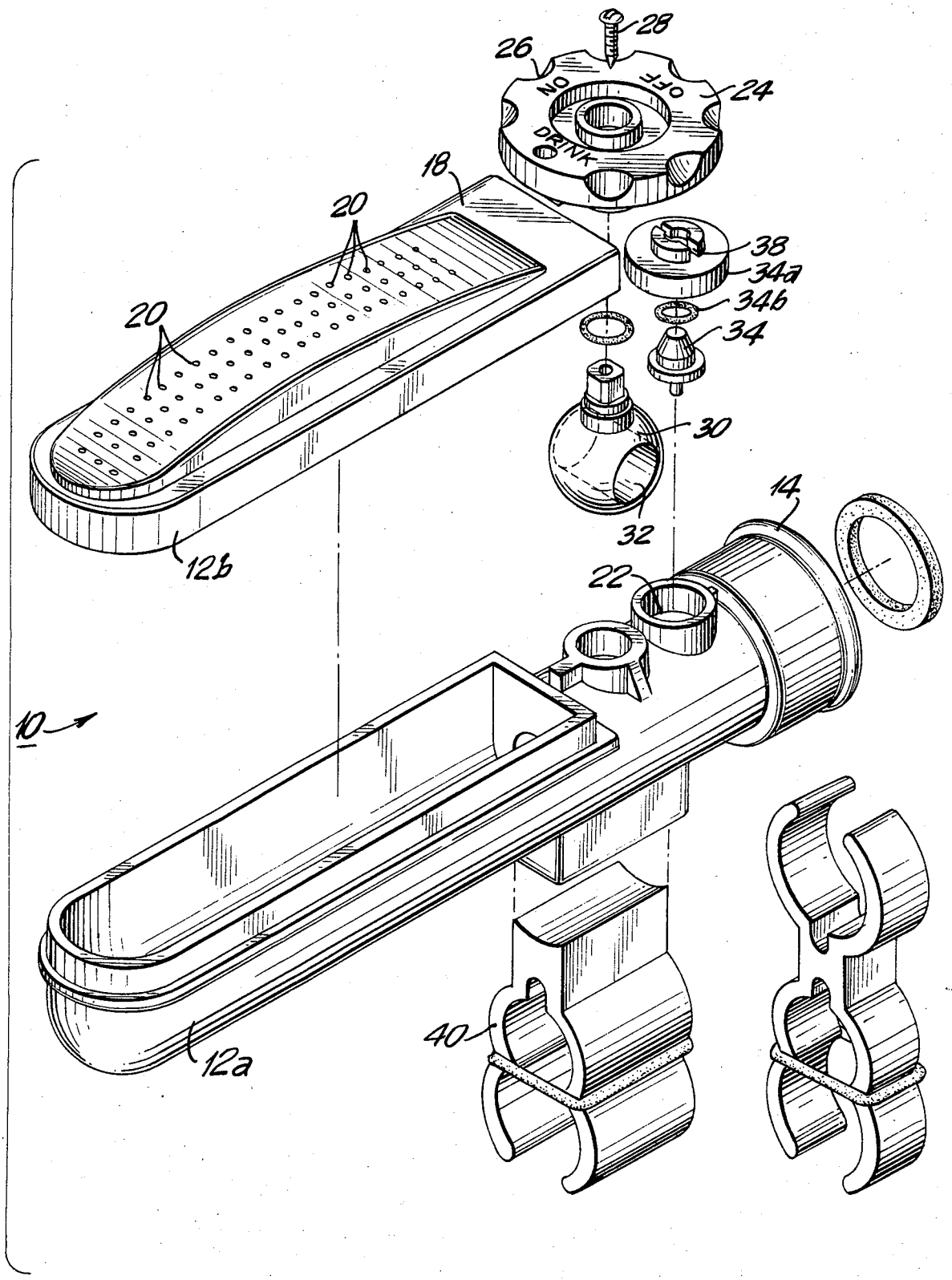
FIG. 1 is an exploded perspective view of the device of the present invention.
Figure 2:
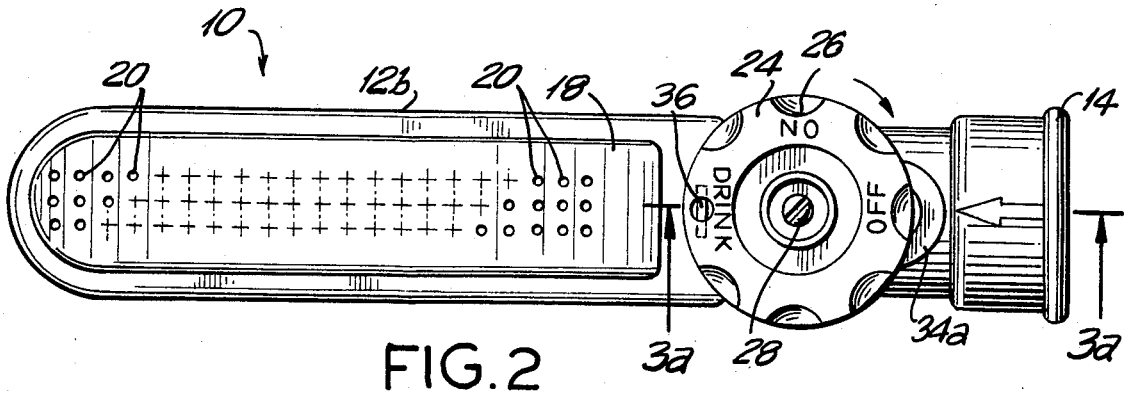
FIG. 2 is a top plan view of the FIG. 1 device.
Figure 3A:
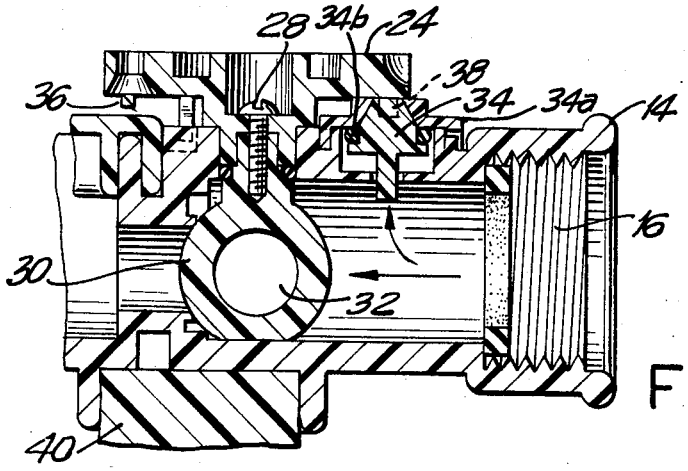
FIG. 3*a* is a sectional view taken generally along line 3*a*—3*a* of FIG. 2, showing the FIG. 1 device with the flow selecting valve in the off state.
Figure 3B:
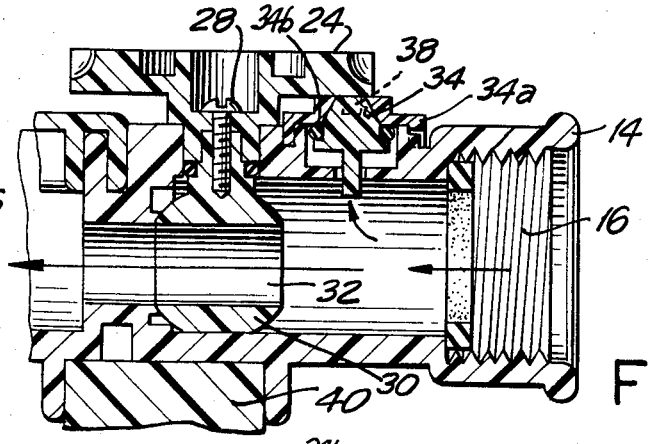
FIG. 3*b* is a view similar to FIG. 3*a* showing the FIG. 1 device with the flow selecting valve in the spray producing state.
Figure 3C:
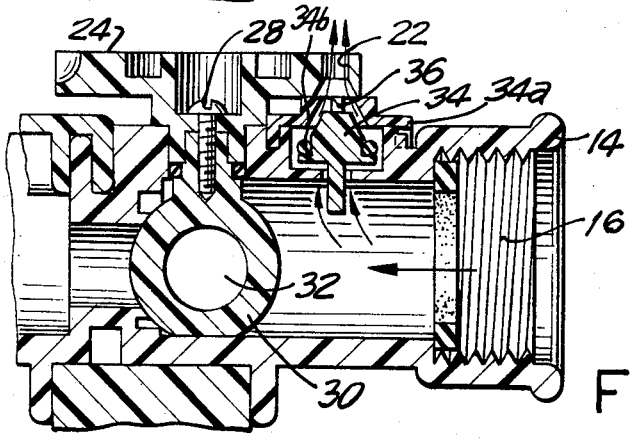
FIG. 3*c* is a view similar to FIG. 3*a* showing the FIG. 1 device with the flow selecting valve in the stream producing state.

Referring now to the drawings, the reference numeral 10 denotes the fountain device of the present invention. The device includes a hollow body portion which preferably is formed, as shown in FIG. 1, in two segments, lower segment 12*a* and upper segment 12*b*. At one end of the elongated hollow body portion is a water inlet 14 through which water can flow from a garden hose into device 10. As best seen in FIGS. 3*a*, 3*b*, and 3*c* the hollow body may be provided with internal threads 16 proximite said water inlet for securely attaching the device to a garden hose.

A water exit surface 18 is provided. Water exit surface 18 is formed with a series of small water exit ports 20 and a large water exit port 22 therein. Large water exit port 22 and small water exit ports 20 are spaced from one another. The water exit surface 18 is in a plane substantially perpendicular to the plane of water inlet 14.

The flow of water in device 10 is controlled by a flow selecting valve which consists of a number of components which are explained more fully hereinafter. The flow selecting valve is capable of assuming three states: an off state, shown in FIG. 3*a*, in which no water flows through the hollow body portion; a spray producing state, shown in FIG. 3*b*, in which water flows through the hollow body portion and exits therefrom through the plurality of small exit ports 20; and a stream producing state in which water flows through the hollow body portion and exits therefrom through the large water exit port 22. All of the components of the flow selecting valve are positioned downstream of the water inlet 14 and upstream of water exit ports 20 and 22.

The flow selecting valve includes a turnable control dial 24 connected to water exit surface 18. Dial 24 can be provided with indicia thereon to indicate the three states of the flow selecting valve. Further, dial 24 may include a series of finger notches 26 therein to aid in the turning thereof.

A fastening screw 28 secures the dial 24 to a cylindrical gate 30. Cylindrical gate 30 is formed with a conduit 32 therethrough. Cylindrical gate 30 has an open position shown in FIG. 3*b* and a closed position shown in FIGS. 3*a* and 3*c*. Gate 30 is upstream from ports 20.

Figure 4A:
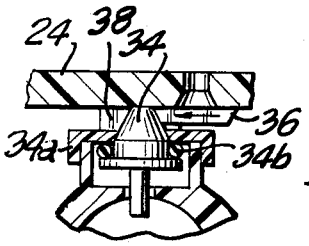
FIG. 4*a* is a detailed sectional view showing the valve head, cam, and cam slot of the FIG. 1 device with the valve head in the closed position.
Figure 4B:
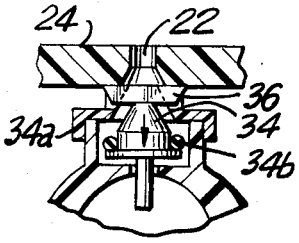
FIG. 4*b* is a view similar to FIG. 4*a* showing the valve head in the open position.

Also secured to dial 24 is a tapered valve head 34. A movable cam 36 is provided which can bear against valve head 34 to move same from a closed position shown in FIG. 4*a* to an open position shown in FIG. 4*b*. A cam slot 38 is provided in which cam 34 can ride. Valve head 34 is upstream from gate 30.

The flow selecting valve works in the following manner. When it is desired to have no water exit from device 10, dial 24 is placed so that the flow selecting valve is in its off state. In this state both cylindrical gate 30 and valve head 34 are in their closed positions causing cylindrical gate 30 to block the flow of water through the device so that no water can exit from either the smaller exit ports 20 or the large exit port 22. When it is desired to have a misting-type spray delivered from the device, the dial 24 is moved so that the flow selecting valve is in its spray producing state. In this state cylindrical gate 30 is open but valve head 34 is closed. Water flows through the conduit 32 and exits from small water exit ports 20. The pressure of the water holds valve head 34 in its closed position so that no water exits through large exit port 22. Valve head 34 in its closed state bears against a sealing rim 34*a* and O-ring seal 34*b* to close off communication to the port 22.

When it is desired to have a stream of water delivered from device 10, dial 24 is moved so that the flow selecting valve is in its spray producing state. In this state cylindrical gate 30 is closed so that no water flows past it. Hence, no water exits from the small water exit ports 20. However, in this state, cam 36 rides in cam slot 38 to bear against the tapered sides of valve head 34 thus depressing the valve head so that the water exits upwardly around the valve head 34, through the rim 34*a* defined opening, to and through large exit port 22.

A chair attaching means 40 is attachable to the device 10. Chair attaching means 40 is constructed so that device can be readily attached to the arm of a chair, chaise, or similar item. This permits a user to keep device 10 easily accessible while sun-bathing and in a position such that dial 24 can be easily moved.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention, and, therefore, such adaptations should and are intended to be comprehended within the meaning and range of equivalence of the following claims.

What is claimed is:

1. A fountain device usable with a hose for selectively producing either a spray or a stream of water, the device comprising:

an elongated hollow body portion having a water inlet formed at one end thereof;

a water exit surface on said body portion, said surface formed with a plurality of small water exit ports and a large water exit port therein; and, flow selecting means for controlling the flow of water through said body portion;

said flow selecting means comprising first valve means positioned in the path of flow or water from said inlet to said small water exit ports and movable between a closed and an open state, second valve means normally closing said large water exit port and movable to an open position to permit flow of water through said large water exit port, and single control means connected to said first and second valve means and operable from a first position in which said first and second valve means are closed, to a second position in which said first valve means is open and said second valve means is closed, and to a third position in which said first valve means is closed and said second valve means is open.

2. The device of claim 1 wherein said first valve means is a gate valve positioned upstream from said small water exit ports, said second valve means being a pressure actuated valve and positioned upstream from said first valve means, said first valve means when in its open position providing communication between said water inlet and said small water exit ports and when in its closed position, blocking said communication, said second valve means being responsive to the water pressure in said hollow body to be forced into its closed position by the water pressure in said hollow body, said second valve means when in its closed position blocking communication to said large water exit port, said control means including a manually operable cam for engaging said second valve means and forcing it into its open position, said second valve means when in its open position, providing communication between said water inlet and said large water exit port.

3. The device of claim 2, in which said control means further comprises: a handle, said first valve means being connected to said handle, said cam being connected to said handle, said handle having a first position in which said first valve means is closed and said cam is spaced from said second valve means, said handle having a second position in which said first valve means is open and said cam is spaced from said second valve means, said handle having a third position in which said first valve means is closed and said cam engages said second valve means to force said second valve means into its second position.

4. A fountain device usable with a hose for selectively producing either a spray or a stream of water, the device comprising:

an elongated hollow body portion having a water inlet formed at one end thereof;

a water exit surface of said body portion, said surface formed with a plurality of small water exit ports and a large water exit port therein;

a flow selecting valve having three states: an off state in which no water flows through said body portion; a spray producing state in which water flows through said body portion and exits therefrom through said plurality of small water exit ports, and a stream producing state in which water flows through said body portion and exits therefrom through said large water exit port, said flow selecting valve being positioned downstream of said water inlet and upstream of said water exit ports; said flow selecting valve comprising first and second valve each having open and closed positions, said first valve being a gate valve positioned upstream from said small water exit ports, said second valve being a pressure actuated valve and positioned upstream from said first valve, said first valve when in its open position providing communication between said water inlet and said small water exit ports and when in its closed position blocking said communication, said second valve being responsive to the water pressure in said hollow body to be forced into its closed position by the water pressure in said hollow body, said second valve when in its closed position blocking communication to said large water exit port, and a manually operable cam for engaging said second valve and forcing it into its open position, said second valve when in its open position providing communication between said water inlet and said large water exit port; said device further comprising a handle, said first valve being connected to said handle, said cam being connected to said handle, said handle having a first position in which said first valve is closed and said cam is spaced from said second valve; said handle having a second position in which said first valve is open and said cam is spaced from said second valve, said handle having a third position in which said first valve is closed and said cam engages said second valve to force said second valve into its second position; said device further comprising a cam slot in the housing of said second valve in which said cam can ride.

5. The device of claim 4 wherein the plane of said water exit surface is substantially perpendicular to the plane of said water inlet.

6. The device of claim 5 further comprising: chair attaching means connected to said hollow body portion for connecting said device to a chair.

7. The device of claim 6 wherein said chair connecting means is on a surface of said hollow body diametrically opposed to said water exit surface.

8. The device of claim 4 wherein said flow selecting valve can assume only one of said three states at a given time.

* * * * *